United States Patent [19]

Henderson et al.

[11] Patent Number: 4,620,521

[45] Date of Patent: Nov. 4, 1986

[54] MODULAR, PROGRAMMABLE HIGH ENERGY IGNITION SYSTEM

[75] Inventors: Robert M. Henderson, Williams Bay; Richard Zechlin, Beloit, both of Wis.

[73] Assignee: Colt Industries Operating Corp., New York, N.Y.

[21] Appl. No.: 631,945

[22] Filed: Jul. 18, 1984

[51] Int. Cl.[4] ..... F02P 1/00

[52] U.S. Cl. ..... 123/599; 123/602; 123/601; 123/149 R; 123/149 C; 310/70 A

[58] Field of Search ..... 123/149 R, 149 D, 149 C, 123/599, 601, 602, 605; 310/70 R, 70 A

[56] References Cited

U.S. PATENT DOCUMENTS

| | | | |
|---|---|---|---|
| 1,921,427 | 8/1933 | Nowosielski | 123/599 |
| 3,311,783 | 3/1967 | Gibbs | 123/599 |
| 3,326,199 | 6/1967 | McMillen | 123/149 R |
| 3,418,990 | 12/1968 | Lindell, Jr. | 123/599 |
| 3,495,579 | 2/1970 | Davalillo | 123/149 R |
| 3,587,550 | 6/1971 | Zechlin | 123/599 |
| 3,828,753 | 8/1974 | Reddy | 123/599 |
| 3,861,373 | 1/1975 | Allwang et al. | 123/599 |
| 3,868,937 | 3/1975 | Zechlin | 123/599 |
| 3,974,816 | 8/1976 | Henderson et al. | 123/599 |
| 4,005,694 | 2/1977 | Noe | 123/605 |
| 4,034,732 | 7/1977 | Van Burkleo | 123/599 |
| 4,193,385 | 3/1980 | Katsumata et al. | 123/599 |
| 4,246,493 | 1/1981 | Beeghly | 123/599 |
| 4,259,938 | 4/1981 | Johansson | 123/599 |
| 4,325,350 | 4/1982 | Bauer | 123/599 |
| 4,406,271 | 9/1983 | Wolf | 123/599 |

*Primary Examiner*—Ronald B. Cox

*Attorney, Agent, or Firm*—Sixbey, Friedman & Leedom

[57] ABSTRACT

The ignition system for providing spark ignition to the cylinders of an internal combustion engine includes a generator assembly adapted to be mounted on said engine. This generator assembly includes a magneto adapted to be driven in response to the operation of the engine to provide output power and a timing unit including at least one rotatable unit driven in timing relationship to the operation of said engine. A control assembly is removably mounted on the generator assembly and incorporates an ignition control circuit connected to receive power from the magneto and operative in response to the timing unit to provide spark ignition to specific cylinders of the internal combustion engine. The control assembly is removable from the generator assembly without altering the timing relationship between rotatable unit and engine.

34 Claims, 7 Drawing Figures

MODULAR, PROGRAMMABLE HIGH ENERGY IGNITION SYSTEM

TECHNICAL FIELD

The present invention relates to capacitive discharge ignition systems generally, and more particularly to a modular high energy ignition system having programmable timing and a novel power supply for safety and shutdown controls.

BACKGROUND ART

The development of solid state semiconductor technology has led to a vast improvement in the design of ignition systems for internal combustion engines. Rotating mechanical distributors in combination with a breaker and breaker points to synchronize fuel ignition with engine operation have been replaced by solid state electronic ignition systems of the inductive and capacitive types. Known capacitive discharge ignition systems often employ the rectified output from a magneto or similar A.C. generator to charge capacitor units which are then discharged by means of a solid state switching circuit into the primary coil of an ignition transformer. As the development of solid state capacitive discharge systems has progressed, improved timing and pulse distribution assemblies have been incorporated into the electronic switching circuitry to obtain enhanced synchronization between engine speed and fuel injection. U.S. Pat. Nos. 3,311,783 to Gibbs et al and 3,587,550 to Zechlin both disclosed electronic ignition control systems with a magnetic timing pulse source driven in correlation to the crankshaft of an engine to generate timing pulses which control the interval during which an ignition trigger pulse is applied to a rotating pulse distributor. Although such timing and pulse distribution systems operate effectively, it has often required complex mechanical or electrical adjustment to vary the timing provided by the ignition system. In some instances where timing variations have to be accomplished in response to a multiplicity of engine and ambient conditions, microprocessor technology must be employed to obtain effective programmable timing.

Also, known solid state capacitive discharge ignition assemblies have been configured in such a manner that the system may not be removed from an engine for servicing and then replaced without retiming the engine to reestablish the desired ignition/engine timing. This generally involves moving the engine from the random position where it last stopped to the number one cylinder position for retiming, and constitutes an additional, time consuming step in ignition system maintenance.

The magnetos developed for use with modern solid state ignition systems have been provided with windings of different types to furnish effective operation over a wide range of engine speeds. Generally a high speed coil is provided having a low number of turns to generate voltage at high speeds, while a low speed coil having a large number of turns is provided to generate voltage at low speeds. Multiple coil magneto systems of this type are shown by U.S. Pat. Nos. 3,861,373 to Allwang et al and 3,974,816 to Henderson et al.

One problem experienced with multiple coil magnetos capable of conducting over a wide range of engine speeds is that switching elements in the solid state ignition circuit powered by the magneto, such as silicon controlled rectifiers (SCR's) used to control the application of power pulses to the ignition transformers, may not shut off properly, thereby causing the ignition circuit to malfunction. The magneto which operates over a wide speed range is capable of generating a continuous current, and this, in combination with the energy stored in the ignition transformers, can cause current to be supplied to the control SCR's at all times. The turn off characteristic of an SCR is such that the current thereto must reduce almost to the zero level before resetting occurs. Therefore, the potential to provide a substantially constant current to the SCR can result in frequent malfunction.

Magnetos having multiple coils of different types must often be housed within large housings which are difficult to install in the space available on an engine. This is due to the fact that the high turn coils generate high heat losses, and to reduce these losses it is necessary to make the volume used for the coil winding as large as possible. The sacrifice in space required to maintain reduced operating temperatures is often not acceptable for many ignition systems applications.

It has been found to be important to provide solid state electronic ignition systems with safety and shutdown controls which operate in response to devices external to the ignition system. U.S. Pat. Nos. 3,418,990 to Lindell, 4,034,732 to Van Burkleo, 4,193,385 to Katsuma et al, and 4,246,493 to Beeghly all disclose safety and shutdown systems of known types. Conventional shutdown systems for capacitive discharge solid state ignition systems take power from the ignition system power capacitor and thereby reduce the energy available for spark ignition. With modern microprocessor engine control systems, it has become more desirable to provide safety and shutdown units which do not reduce the energy level available for ignition.

Finally, with present solid state ignition systems, it is possible to inadvertently short out or ground the primary side of the ignition transformers and thereby damage the control SCR's and system capacitors. In practice, the wiring for the ignition transformers is not done during the manufacture of the magneto and solid state ignition system, but is done later by the end user or engine manufacturer. If this subsequent wiring is improperly accomplished, transformer shorting is likely.

DISCLOSURE OF THE INVENTION

It is a primary object of the present invention to provide a novel and improved solid state capacitive discharge ignition system which requires no external electrical power supply. A novel magneto structure having a single magnetic rotor includes a stator coil structure designed to generate capacitor charging voltages over a wide range of engine speeds. A separate stator coil provides power for safety and shutdown systems and for other system uses.

Another object of the present invention is to provide a novel and improved solid state capacitive discharge ignition system which includes a magneto power generator having two sets of stator coils with one coil being electrically isolated from the remaining three coils. The coils are arranged in an oval shaped housing, and the isolated coil provides power for engine monitoring and control functions.

A further object of the present invention is to provide a novel and improved solid state capacitive discharge ignition system having programmable timing responsive to remote open loop or closed loop control. A simple, electrical timing unit operates in response to sensed conditions or manual control to alter firing position timing. A magneto assembly includes both high wind and low wind stator coils for providing power to the system capacitor and the programmable timing unit.

Yet another object of the present invention is to provide a novel and improved solid state capacitive discharge ignition system for an internal combustion engine which is mounted in a multi-piece housing secured to the engine. A generator section is secured to the engine and includes a magneto, a rotatable timing unit and a pulse distributor rotor. A control section is removably secured to the generator section and includes the pulse distributor stator and the system electronics. Removal of the control section from the generator section does not disturb the ignition/engine timing.

A still further object of the present invention is to provide a novel and improved solid state capacitive discharge ignition system having a short circuit protection unit which protects the electrical components of the system from the effects of ignition transformer shorting or grounding. This short circuit protection unit additionally operates to provide energy transfer from the system storage capacitor to the ignition spark generating unit and extends the duration of the spark.

Yet a further object of the present invention is to provide a novel and improved solid state capacitive discharge ignition system having a transorb protection unit for each system SCR solid state power switch. This protection system assures SCR turnoff over a wide range of engine speeds and provides a longer spark duration.

These objects are accomplished by providing a modular, programmable high energy ignition system for an internal combustion engine having a power providing magneto unit which is driven from the engine. This magneto includes a magnetic rotor and at least a high speed, low turn coil, a low speed high turn coil and a separate power coil mounted within an oval housing structure. The separate power coil is electrically isolated from the high and low speed coils which provide power to charge the system capacitor. This isolated power coil provides a separate source of power for a shut down assembly responsive to external sensed conditions, as well as for various monitoring units.

A programmable timing unit includes a variable resistance or voltage generating unit coupled to the magneto and operative to control the charging of a timing capacitor or to bias the power switches for system ignition transformers.

The ignition system is designed to facilitate the removal of the electronic ignition cirucit, the pulse distributor stator and the programmable timing components from an engine for servicing and replacement of these components without disturbing engine/ignition system timing. This is accomplished by mounting the ignition system magneto, timing pulse generator and the rotor for the pulse distributor in a generator housing section on the engine. The system electronics, pulse distributor stator and the programmable timing circuit are mounted on a control housing section which is removably secured to the generator housing section.

To protect the ignition system against the effects of ignition transformer short circuiting or grounding, a current limiting inductor is placed in the circuit between the system storage capacitor and the SCR power switches and operates to limit current to a value below the pulse current carrying capability of each SCR power switch in the event of ignition transformer short circuiting or grounding. This inductor also operates to extend or enhance the power pulse provided to an ignition transformer.

Finally, the SCR power switches are enabled to operate effectively over a wide range of engine speeds by transorb protection units which constitute "sloppy" zener diodes operable to provide a path for the ignition transformer primary current to "spin out" without going through the associated power SCR.

BEST MODE FOR CARRYING OUT THE INVENTION

Figure 1:
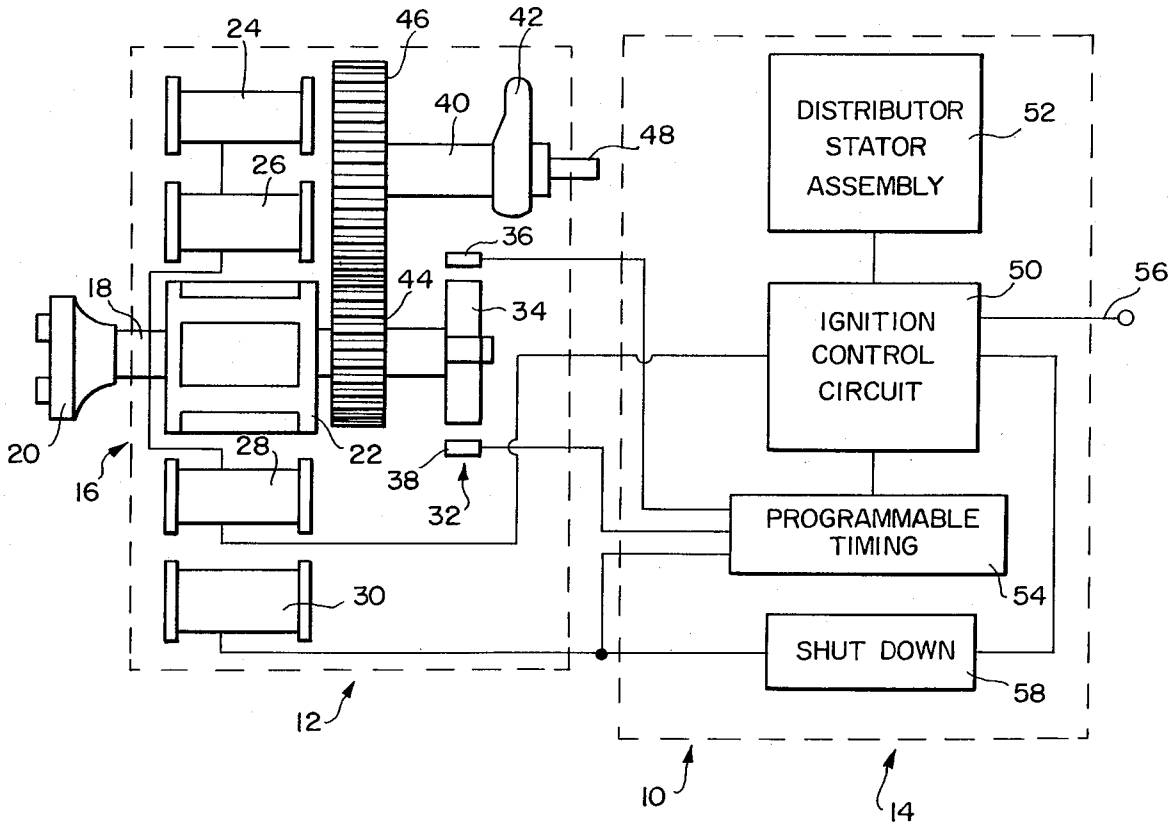
FIG. 1 is a diagrammatic illustration of the modular, programmable high energy ignition system of the present invention.

Referring now to FIG. 1, the modular, programmable high energy ignition system indicated generally at 10 includes a generator section 12 and a control section 14. The generator section includes a magneto 16 having a rotor shaft 18 which is driven by an internal combustion engine through a coupling 20. Mounted upon the rotor shaft is a permanent magnet rotor 22 which generates ignition power in combination with a stator including stator coils 24, 26 and 28. A fourth stator coil 30, which is electrically separate from the coils 24, 26 and 28, also cooperates with the rotor 22 to provide output power. The rotor 22 may consist of a permanent magnet eight pole rotor which operates in combination with a multiple pole stator to provide all of the power required by the ignition system 10.

The magneto 16 is an asymmetrical generator and operates to provide sufficient voltage for the remainder of the ignition system over a wide range of engine speeds. For example, this magneto provides sufficient output in a range extending from engine starting speeds of around fifty rpm to top engine speeds exceeding three thousand rpm. To provide this wide range of operation, a low speed set of stator coils 24 and 26 is provided wherein each coil has many wire turns. These coils operate effectively at low engine speeds to produce a high voltage output, but because of high coil impedance, the low speed coils lose their capacitor voltage generating capability at higher speeds. Thus a high speed coil 28 having a low number of wire turns is used to generate voltage at higher speeds. In combination, these high and low turn coils provide the desired system voltage characteristic across a full operating range of engine speeds.

The rotor shaft 18 is extended to drive a pulse timing generator 32 of the conventional type which includes a shaft mounted magnet and salient pole rotor 34. This rotor cooperates with two series wound trigger coils 36 and 38 to provide accurate timing pulses for the system 10.

Ignition spark to various engine cylinders is provided under the control of a pulse distributor assembly which operates similar to a rotating transformer to select the proper engine cylinder to which an ignition signal is directed. This distributor assembly includes a rotor having a central shaft 40 which mounts a transformer central arm 42 for rotation. The transformer central arm generally rotates at a speed which differs from the speed of rotation of the salient pole rotor 34, and consequently, the rotor shaft 18 carries a gear 44 which drives a gear 46 for the shaft 40. Gears 44 and 46 may constitute differential gearing capable of creating any desired speed differential between the rotational speed of the salient pole rotor 34 and the transformer central arm 42. It will be noted that the central shaft 40 includes a shaft extension 48 which extends outwardly from the transformer central arm 42 beyond the confines of the generator section 12.

The control section 14 includes a solid state ignition control circuit 50 containing the ignition system power capacitor and solid state SCR switching circuit as well as a pulse distributor stator assembly and circuit 52. The distributor stator assembly includes a pole structure which cooperates with the transformer central arm 42 to select and activate SCR switches necessary to provide spark ignition to specific engine cylinders, and the ignition control circuit 50 provides this spark ignition from power provided thereto by the magneto stator coils 24, 26 and 28. The timing of this spark ignition is controlled by the pulse timing generator 32 and a programmable timing unit 54. The programmable timing unit is also mounted in the control section 14 and is powered by the magneto stator coils. The timing pulses provided by the pulse timing generator through the pulse distributor control the ignition pulses output from the ignition control circuit 50 on an output 56 to the various engine ignition transformers. The power coil 30 may provide power to a shutdown unit 58 in the control section 14 which operates in response to engine and other components external to the ignition system 10, or power to the shutdown unit may be provided by the remaining stator coils.

Figure 2:
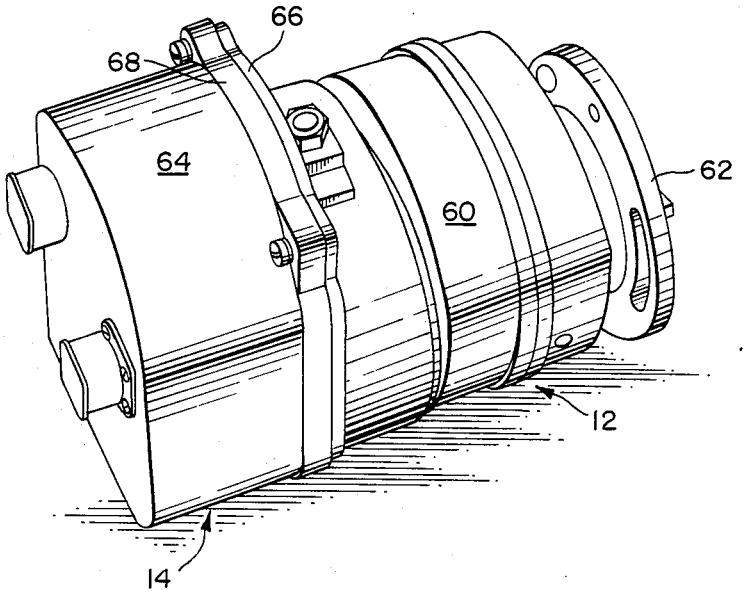
FIG. 2 is a perspective view showing the structure of the ignition system of FIG. 1.
Figure 3:
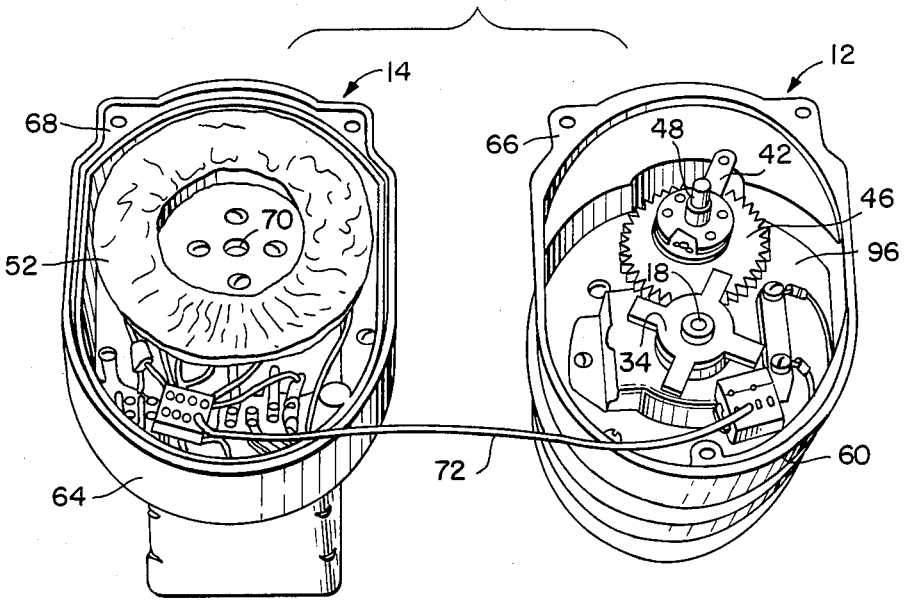
FIG. 3 is a perspective view showing the generator and control sections of the ignition system of FIG. 2 disconnected.

With reference to FIGS. 2 and 3, it will be noted that the generator section 12 of the ignition system 10 is mounted in a first housing assembly 60 having substantially an oval shape and including a first mounting flange 62 positioned at one end thereof. The oval housing assembly mounts the pulse timing generator 32, the gears 44 and 46, the transformer central arm 42, and the magneto 16. This oval configuration provides ample space for the stator coils 24, 26, 28 and 30, and permits the coils to be wound with larger wire, since a greater coil volume at this location can be accommodated. By doing this, heating losses are reduced considerably and operating temperatures are also reduced.

The first housing assembly 60 of the generator section 12 is designed to be secured directly to an internal combustion engine by means of the mounting flange 62, and the control section 14, which is mounted in a second housing assembly 64, is designed to mate therewith. The second housing assembly is secured to the first housing assembly by means of a second mounting flange 66 on the assembly 60 which cooperates with a similar mounting flange 68 on the assembly 64. It will be noted that the pulse distributor stator assembly 52 includes a central bore 70 to receive the distributor shaft extension 48 when the housing assemblies 60 and 64 are assembled. This assures that the transformer central arm 42 is properly positioned with respect to the distributor stator pole structure.

The generator section 12 is electrically connected to the control section 14 by means of an electrical connector 72 which may be unplugged when the control section 14 is removed from the generator section 12 for service.

It is extremely important to note from FIGS. 2 and 3 that the removal of the control section 14 does not disturn the ignition/engine timing, since both the pulse timing generator 32 and the transformer central arm 42 with the drive gearing therefor remain in place on the engine. Thus, the engine can stop at any position, and the control section can be removed for servicing and then replaced without bringing the engine to the number one cylinder position for retiming. Servicing can be performed merely by removing bolts from the mounting flanges 66 and 68 and disconnecting the connector 72 and then subsequently reassembling these components. When the components are reassembled, the engine is in time.

Figure 4:
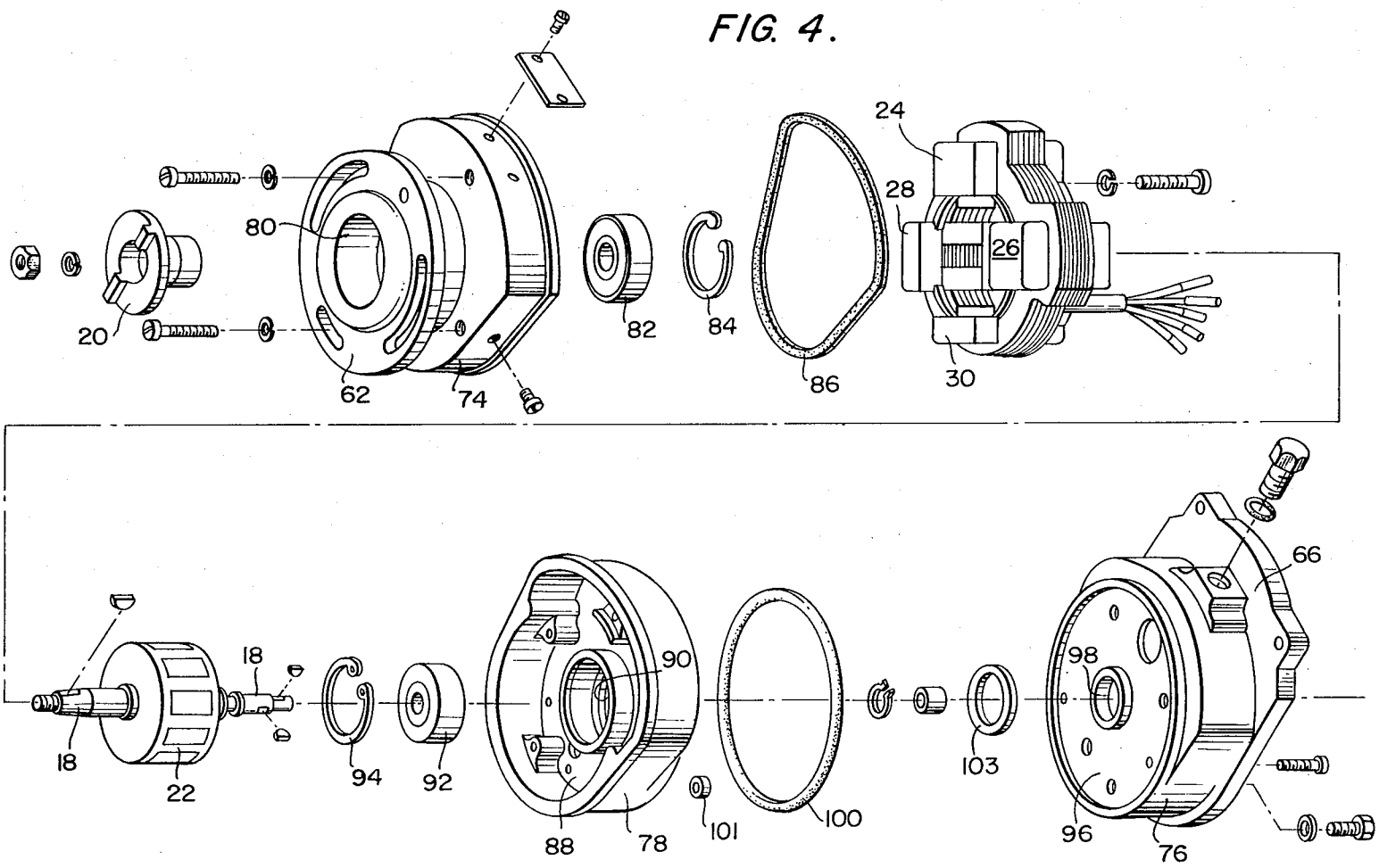
FIG. 4 is an exploded view of the generator section of FIG. 3.

FIG. 4 illustrates the manner in which components are arranged within the generator section 12 as well as the manner in which the first housing assembly 60 is formed to provide maximum thermal insulation. It is important that the heat generated in the stator coils 24, 26, 28 and 30 be substantially reduced before it reaches the circuitry of the control section 14 to prevent thermally induced damage or malfunction of such circuitry.

The first housing assembly 60 is formed by two end housing sections 74 and 76 and a central housing section 78 which are joined together as a unit. The end housing section 74 and the central housing section 78 mate to form an enclosure for the stator unit, including the coils 24, 26, 28 and 30, which receive the permanent magnet rotor 22. A bore 80 in the end wall of the housing section 74 receives a bearing 82 for the rotor shaft 18 and is held in place by a spring retainer 84. The rotor shaft extends through the bearing 82 and the coupling 20 and is secured to the coupling by a suitable nut and lock washer combination. A gasket 86 seals the end and center housing sections 74 and 78.

The oval shape of the housing sections 74 and 78 is designed to efficiently receive the stator coils 24, 26, 28 and 30 in a minimum space with maximum separation for enhanced thermal dissipation. Note in FIG. 4 that the larger, high winding coils 24 and 26 are positioned in the wider upper portion of the enclosure formed by the oval housing sections 74 and 78 while the smaller low winding coils 28 and 30 are located in the reduced lower portion of the enclosure. The coils 28 and 30 are angularly mounted in the stator housing structure so that the lower extremities of these coils are much closer together than the upper extremities thereof, and maximum spacing between the coils within the lower portion of the enclosure is achieved.

The central housing section 78 includes an end wall 88 with a bore 90 which receives a bearing 92 held in place by a spring retainer 94. The shaft 18 of the rotor 22 passes through the bearing 92 and into the end housing section 76. This end housing section includes an end wall 96 which includes a central bore 98 for the shaft 18. The end housing section 76 is secured to the center housing section 78 and sealed thereto by a gasket 100. The end walls 88 and 96 are spaced apart by the gasket 100 and bushings 101 and 103 of thermal insulating material to provide a thermal barrier between the coils 24, 26, 28 and 30 and the circuitry of the control section 14. The shaft 18 passes through the bore 98 and is connected to the gear 44 and the rotor 34 as shown in FIGS. 1 and 3.

Figure 5:
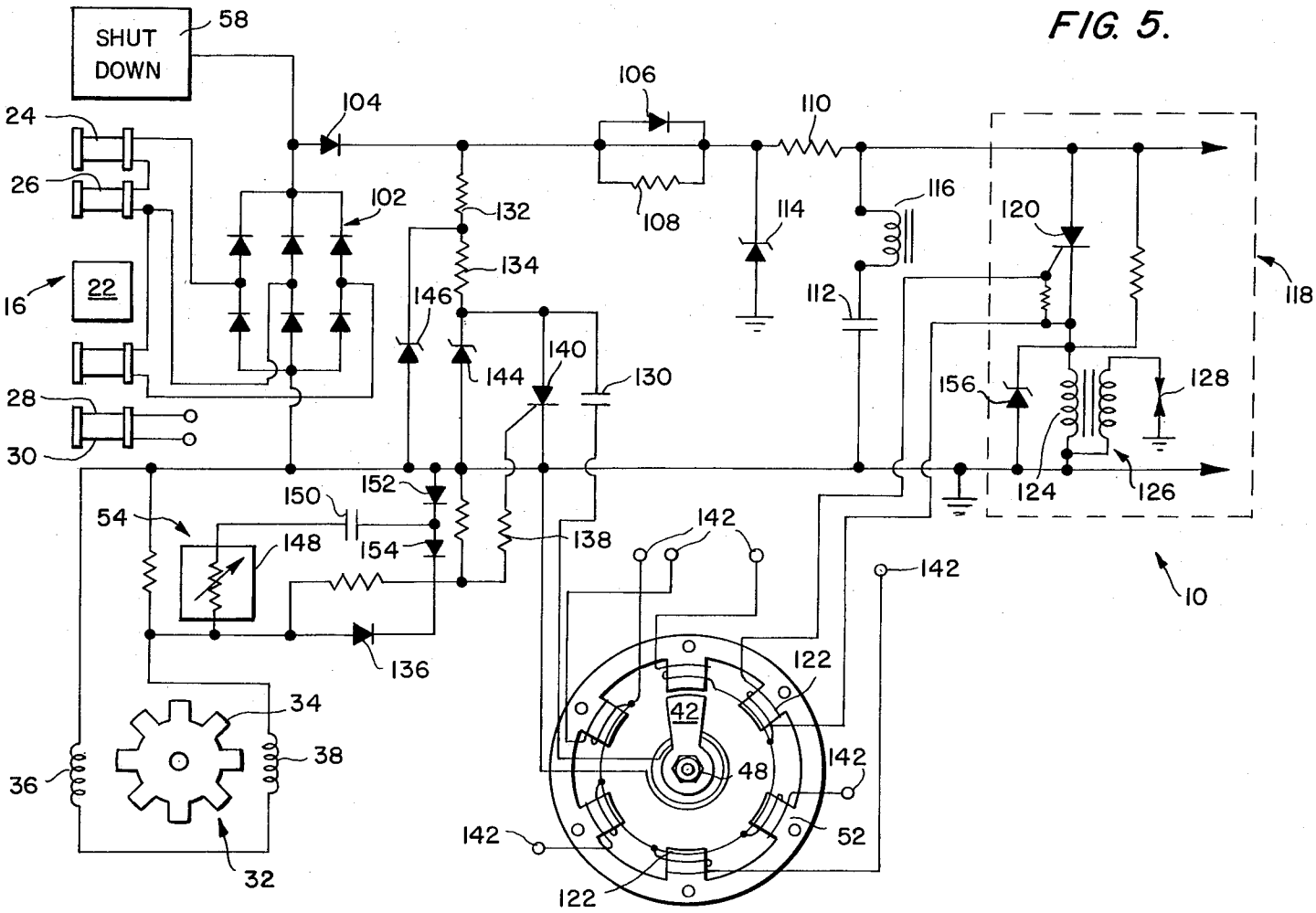
FIG. 5 is a circuit diagram of the modular, programmable high energy ignition system of the present invention.

FIG. 5 illustrates the basic circuitry employed for the moldular, programmable high energy ignition system 10 of the present invention. Many components of the ignition circuitry are substantially the same as those illustrated in the aforementioned U.S. Pat. No. 3,587,550 to Zechlin, and the disclosure of this patent is incorporated herein by reference. Basically, the magneto 16 provides power by means of the high speed and low speed coils 24, 26 and 28 to a full wave, three phase rectifier bridge 102, the output of which is connected through an isolating diode 104, a parallel diode/resistor combination 106 and 108, a resistor 110 and an inductor 116 to a power capacitor 112. A zener diode 114 connected between the resistor 110 and the parallel diode 106 and resistor 108 operates as a charge limiting unit to protect system components against operation beyond component inherent potential capacities. It will be noted that the isolating diode 104 operates to isolate the shut down circuit 58 from the circuit for the power capacitor 112.

Power from the rectifier bridge 102 charges the power capacitor 112, and it is the discharge of this capacitor through a current limiting inductor 116 to a switching section 118 which provides power for engine ignition. The switching section 118 includes a plurality of semiconductor switches which are generally silicon controlled rectifier (SCR) switches. One such switch 120 is shown in FIG. 5 for purposes of description, but in actual use, a semi-conductor switch 120 will be provided for each engine cylinder.

The semiconductor switch is operated in known manner by the output of the pulse distributor stator assembly 52. As the transformer central arm 42 thereof rotates past a pole piece 122 of the distributor stator assembly, a voltage is induced in a winding on the pole piece and is conducted to the gate electrode of a selected semiconductor switch 120. This causes the semiconductor switch to conduct and discharge the power capacitor 112 into the primary winding 124 of an ignition transformer 126, thereby causing a spark across a spark gap 128. This results in the firing of an engine cylinder.

At substantially the same time that the power capacitor 112 is being charged by the rectified output of the bridge 102, a second capacitor 130 is also charged by the output from the rectifier bridge provided across the series resistors 132 and 134. Then, as the rotor 34 of the pulse timing generator 32 rotates past the trigger coils 36 and 38, flux changes occur in the trigger coils which cause a pulse voltage to pass to a diode 136 and a resistor 138 to gate an SCR switch 140.

The SCR switch 140 is connected in a series circuit with a center coil for the transformer central arm 42, and when the SCR switch is gated into conduction, the capacitor 130 discharges in a path through the anode to cathode circuit of the SCR and the center coil of the transformer central arm. Thus the operation of the pulse timing generator 32 controls the timing of the ignition pulse provided to an ignition transformer 126, while the position of the transformer central arm 42 relative to the pole pieces 122 determines which ignition transformer will be fired. Outputs 142 from the respective pole pieces 122 control other semiconductor switches 120 (not shown) in the switching circuit 118.

Voltage control zener diodes 144 and 146 are connected respectively across the SCR 140 as well as across the resistor 134 and the SCR 140. Thus the SCR 140 provides an accurately controlled timing pulse from the capacitor 130 to the transformer central arm 42. The timing of this pulse can be electronically varied by means of the programming unit 54 which, in FIG. 5 includes a variable resistor 148 in series with a capacitor 150 which is connected between isolating diodes 152 and 154. This programming circuit, which shunts the diode 136, may be operated to vary the firing time of the SCR 140 and thus the timing of the pulse provided to the semiconductor switch 120. By varying the resistance of the variable resistor 148, the time that it takes a timing pulse to reach the amplitude necessary to gate the SCR 140 into conduction is changed, thereby changing the time of occurrence that a pulse is passed by the transformer central arm 42 to a pole piece 122 and a semiconductor switch 120. By varying the resistance of this variable resistor, the spark ignition for the engine may be either advanced or retarded.

Although the programmable timing unit 54 has been disclosed as including a variable resistor 148, this variable resistor can constitute any suitable sensor or other device responsive to an external condition which would vary the gating pulse provided to the SCR 140. This permits accurate timing of the firing position to be achieved electronically in response to either external devices or to engine condition, and remote open loop or closed loop control can be employed.

Since the wiring for the ignition transformer 126 is external to the remainder of the ignition system, the primary 124 of this transformer may be inadvertently shorted or grounded either in installation or in later operation. Normally, such shorting or grounding might injure either the semiconductor switches 120 or possibly the power capacitor 112, and to prevent this, the current limiting inductor 116 is provided in the circuit. The inductance value of this current limiting inductor is small compared to the inductance of the transformer 126, and therefore has minimal effect on circuit operations. However, when the primary 124 is shorted to the return path to the capacitor 112, current will be limited by the value of the series circuit consisting of the current limiting inductor 116 and the capacitor 112. This LC circuit determines the peak value of current flow, and the inductance of the current limiting inductor is chosen to limit current to a value below the pulse current carrying capability of the switches 120.

As previously indicated, the coils 24, 26 and 28 of the magneto 16 permit operation of the ignition circuit over an extremely wide range of engine speeds. One of the problems resulting from this type of operation is that the magneto can provide a continuous current, and in combination with the stored energy in the ignition transformers 126, current is supplied to power the semiconductor switches 120 at all times. Since the turn off characteristic of these SCR semiconductor switches is such that the current must reduce to almost zero before resetting occurs, the SCR will tend to stay on and the ignition system will malfunction. To prevent this, a diode 156 is added between the cathode of the SCR semiconductor switch 120 and the circuit ground line to provide a path for the transformer primary current to "spin out" without going through the power SCR. Thus the current in the conducting SCR is reduced so that the SCR can turn off. Unfortunately, poor grounds create a high voltage across a normal diode in the reverse direction and cause a voltage breakdown. Consequently, the diode 156 is a "transorb" (sloppy zener) instead of a simple diode, and the avalanche characteristics of the transorb eliminate the high voltage breakdown problem.

It will be noted in the ignition system of FIG. 5 that the coil 30 is provided to drive various external electrical components, not shown, while the shutdown system 58 is driven from the rectifier bridge 102. This shutdown unit may constitute any control switch means which is actuable to complete a circuit upon detecting a malfunction in the operation of the engine associated with the ignition system 10. This control switch may be actuable in response to abnormal engine conditions such as vibration, temperature, pressure, speed or the like.

The addition of the fourth stator coil 30 and the programmable timing unit 54 to a solid state capacitive discharge ignition system provides a versatility which facilitates a number of operating embodiments. For example, with reference to FIG. 6, an ignition circuit indicated generally at 168 is disclosed wherein the fourth stator coil 30 cooperates with the programmable timing unit 54 to directly effect the timing of the semiconductor switches 120. In this circuit, the stator coils 24, 26 and 28 provide power to a rectifier bridge 170 which provides the charge to a power capacitor circuit 172 in known manner. The power capacitor circuit in turn discharges through the primary winding 124 of a respective ignition transformer 126 when the semiconductor switch 120 therefor is rendered conductive by a timing pulsor assembly 174. To this point, the circuit 168 operates in substantially the same manner as the ignition circuit 10 of FIG. 5.

The forth stator coil 30 provides power to a full wave bridge rectifier 176 which operates to charge a biasing capacitor 178 through the variable resistance of the programmable timing circuit 54. The programmable timing circuit can be varied to change the time required to charge the biasing capacitor 178 to a predetermined point, and this will vary the bias on the cathode circuit of each of the semiconductor switches 120. This in turn will vary the firing time of each of the semiconductor switches 120 in response to a pulse from the pulsor assembly 174 in accordance with the amount of charge on the capacitor 178, and consequently, the setting of the programmable timing unit 54 directly effects the firing time of each of the semiconductor switches. Additionally, the capacitor 178 provides a biasing charge on the cathode circuit of each of the semiconductor switches 120 which aids in causing the switch to positively turn off when the pulse from the pulsor assembly 174 is removed from the gate thereof.

The variable timing provided by the capacitor 178 may change automatically in response to engine speed by eliminating a limiting zener diode 182. For some applications, this is desirable. As engine speed changes, the power output of the fourth stator coil 30 correspondingly changes to change the charging time of capacitor 178.

The AC output from the fourth stator coil 30 may be taken from a point before the rectifier bridge 176 to power AC instrumentation 180, such as engine tachometers and similar instruments. If desirable, the DC output from the rectifier bridge 176 may be taken to power the shut down circuit 58 directly, as is illustrated in FIG. 1.

The use of differential gears 44 and 46 to drive the transformer central arm 42 of the pulse distributor assembly provides timing flexibility which is important if the modular programmable high energy ignition system 10 is to be effectively used with some multi-cylinder engines. Normally, for four cycle engines, the transformer central arm 42 of the pulse distributor assembly rotates at one half engine speed, while for two cycle engines, the transformer central arm rotates at engine speed. However, on some multi-cylinder engines, usually the large bore engines, there are firing angles which are difficult to obtain with these normal speed ratios. This is due to the fact that the firing angles between cylinders are as follows:

| Cylinder | Degrees Between Cyl. |
|---|---|
| #1 | 0 |
| #2 | +63° |
| #3 | +9° |
| #4 | +63° |
| #5 | +9° |

With the firing angles indicated above, it is difficult to separate the firing of cylinders such as the number 2 and number 3 cylinders because of the small angle between the two. However, if the gear ratio between the gears 44 and 46 is altered so that the transformer central arm 42 doubles in speed, then the transformer central arm will rotate at engine speed for four cycle engines and at twice engine speed for two cycle engines. This in effect doubles the firing angle between engine cylinders, so that the firing angles become as follows:

| Cylinder | Degrees Between Cyl. |
|---|---|
| #1 | 0 |
| #2 | +126 |
| #3 | +18 |
| #4 | +126 |
| #5 | +18 |

Figure 7:
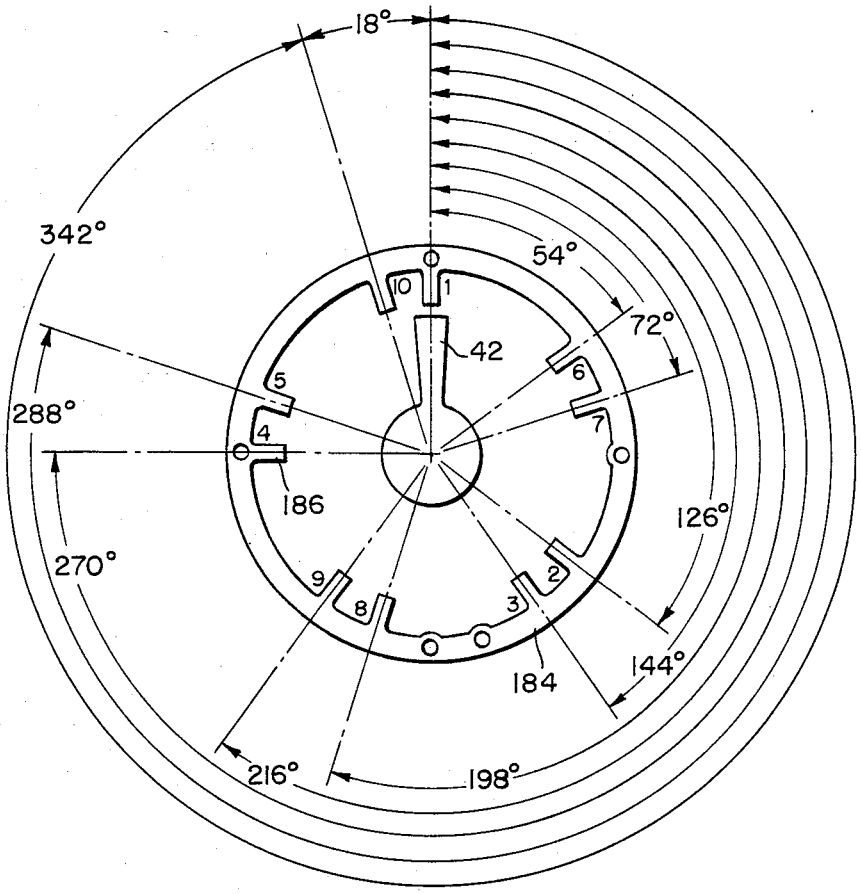
FIG. 7 is a pulse distributor stator diagram shown the firing angles for a ten cyclinder engine.

The new firing angles are illustrated in the diagram of FIG. 7 wherein a pole structure for the distributor stator assembly is illustrated at 184. This stator assembly incudes ten poles upon which the pick up coils are placed. As previously indicated, each coil provides a pulse for the firing of a specific engine cylinder when the transformer central arm 42 rotates past the pick up coil. In FIG. 7, the pulse distributor stator assembly 184 includes ten pole pieces 186, and each pole piece is numbered with the number of the engine cylinder which it fires. It should be noted that these pole pieces are arranged for the normal 63° and 9° firing angles previously described, but with the transformer central arm 42 rotating at twice the normal speed, these firing angles become doubled. It now takes two complete revolutions of the transformer central arm to fire all ten cylinders instead of one revolution at the normal speed. Now five cylinders are fired on the first revolution and five more on the second, and it is important that the pole pieces 186 be arranged so that they are mechanically separated and do not interfere with with one another on the second revolution. It may be seen from the diagram of FIG. 7 that the pole pieces for engine cylinders 6, 7, 8, 9 and 10 are offset from the pole pieces for the first five cylinders so that there is no mechanical interference during the second revolution of the transformer central arm 42. The arrangement of the pulse distributor stator 184 in the manner shown in FIG. 7 is much more efficient than previous systems often used for ten cylinder engines wherein two separate five cylinder ignition systems were used instead of the single ignition system of the present invention.

INDUSTRIAL APPLICABILITY

Figure 6:
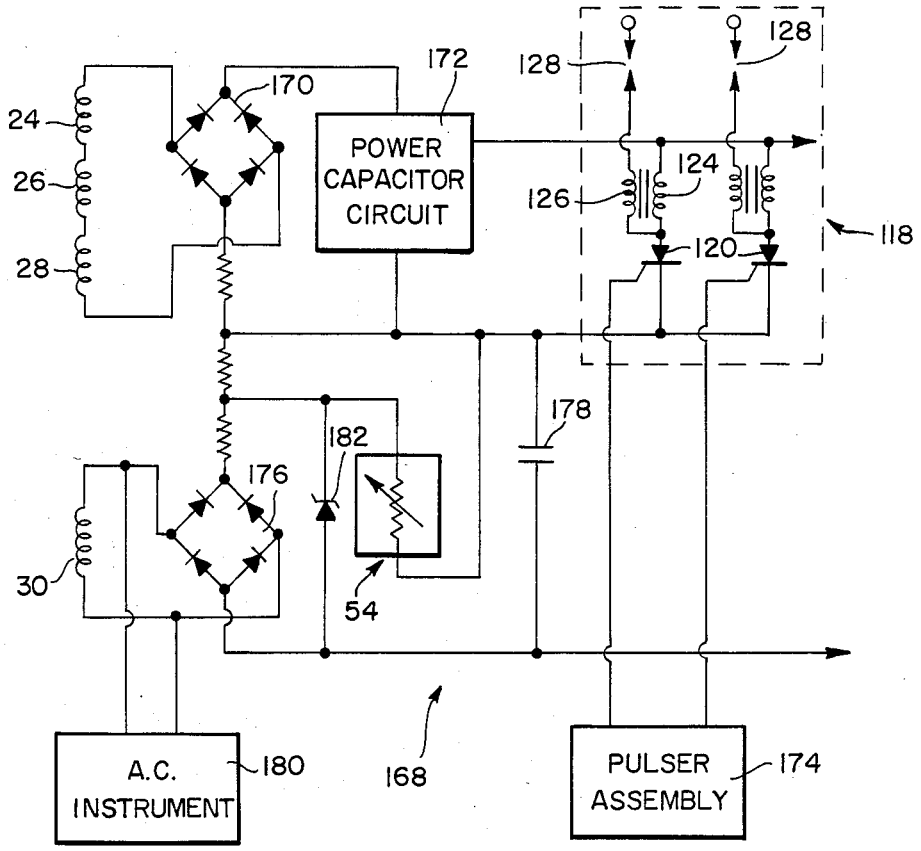
FIG. 6 is a circuit diagram of a second embodiment of the modular programmable high energy ignition system of the present invention.

The modular, programmable high energy ignition system of the present invention operates effectively to provide ignition with a simple variable timing control to an engine. In the systems of both FIGS. 5 and 6, varying the resistance of the programmable timing unit 54 at one point in the circuit operates to vary the timing on all engine cylinders. In the circuit of FIG. 5, this is accomplished by varying the firing point of the SCR 140 and thus the timing of the pulses provided to all of the semiconductor switches 120. In the circuit of FIG. 6, the same result is achieved by changing the bias on a common cathode line for all of the semiconductor switches 120.

The fourth stator coil 30 of the modular programmable high energy ignition system operates effectively to power external AC as well as DC assemblies. Thus, the devices external to the ignition, such as gas valve shut-offs, oil temperature and pressure units, and even the circuit shutdown system may be powered from this additional stator coil. When powered in this manner, these external units do not reduce the energy level available for ignition.

The modular packaging of the ignition system of the present invention is designed to both provide space for high and low speed coils as well as the additional stator power coil, and is also designed to thermally isolate these coils from the circuitry of the system. Also, the modular system is designed such that the electronic section may be removed from the system for servicing and then replaced without retiming the engine. This is accomplished by isolating the timing portion of the system in a modular section which remains connected to the engine.

Damage to the solid state semiconductor switches 120 for the ignition system is precluded by the inductor 116 in series with the power capacitor 112. During normal operation, the inductor stores power discharged from the power capacitor 112 to extend the duration of the spark producing current passing through an activated semiconductor switch 120. Also this stored energy in the inductor will reverse charge the power capacitor 112 when this power capacitor has discharged to a low level, and this reverse charge causes the power capacitor to bias the cathode circuit of the conducting semiconductor switch 120 to positively shut this switch off. This, in combination with the action of the transorb 156 is important for ignition systems which operate over a wide range of engine speeds.

We claim:

1. An ignition system for providing spark ignition to the cylinders of an internal combustion engine comprising a generator assembly means adapted to be mounted on said engine, said generator assembly means including a magneto means adapted to be driven in response to the operation of said engine to provide output power, said magneto means including a magneto stator having at least one high speed stator coil with a number of coil windings to provide a high voltage output at high speeds of said internal combustion engine, at least one low speed stator coil having a number of coil windings which exceeds those of said high speed stator coil and which provide a high voltage output at low speeds of said internal combustion engine, and a power coil electrically isolated from said high and low speed stator coils, and timing means including at least one rotatable unit driven in timing relationship to the operation of said engine, and a control assembly means removably mounted on said generator assembly means, said control assembly means including ignition control circuit means connected to receive power from said magneto means and operative in response to said timing means to provide spark ignition to specific cylinders of said internal combustion engine, said control assembly means being removable from said generator assembly means without altering the timing relationship between said rotatable unit and said engine.

2. An ignition system for providing spark ignition to the cylinders of an internal combustion engine comprising a magneto means adapted to be driven in response to the operation of said engine, said magneto means including a magneto stator having first stator coil means and second stator coil means electrically isolated from said first stator coil means, a plurality of electronic switching means, each activated upon receipt of a triggering pulse to provide a current path therethrough, capacitor means connected to discharge through each of said electronic switching means when said switching means is activated, said magneto means operating to charge said capacitor means, and triggering means adapted to provide triggering pulses to activate said electronic switching means individually at different times, said triggering means including variable programmable timing means operative to uniformly adjust the actuation time of all said electronic switching means in response to said triggering pulses.

3. An ignition system for providing spark ignition to the cylinders of an internal combustion engine comprising a generator assembly means adapted to be mounted on said engine, said generator assembly means including a generator assembly housing having a first housing section and a second housing section separated from said first housing section by a dividing wall, a magneto means mounted in said first housing section and adapted to be driven in response to the operation of said engine to provide output power, timing means mounted in said second housing section and including at least one rotatable unit driven in timing relationship to the operation of said engine and drive means extending through said dividing wall and coupling said magneto means to the rotatable unit of said timing means, said rotatable unit being mounted to extend outwardly beyond the confines of said second housing section, and a control assembly means removably mounted on said generator assembly means, said control assembly means including ignition control circuit means connected to receive power from said magneto and operative in response to said timing means to provide spark to specific cylinders of said internal combustion engine and stator means formed and positioned to extend concentrically about the rotatable unit of said timing means when said control assembly means is mounted upon said generator assembly means, said control assembly means being removable from said generator assembly means without altering the timing relationship between said rotatable unit and the engine.

4. An ignition system for providing spark ignition to the cylinder of an internal combustion engine comprising a generator assembly means adapted to be mounted on said engine, said generator assembly means including a generator assembly housing having a first housing section and a second housing section separated from said first housing section by a dividing wall, a magneto means mounted in said first housing section and adapted to be driven in response to the operation of said engine to provide output power, timing means mounted in said second housing section and including at least one rotatable unit driven in timing relationship to the operation of said engine, and a control assembly means removably mounted on said generator assembly means, the dividing wall separating said second housing section from said first housing section being a thermal isolating wall which operates with said second housing section to thermally isolate said control assembly means from said magneto means when the control assembly means is mounted on said generator assembly means, said control assembly means including ignition control circuit means connected to receive power from said magneto means to provide spark ignition to specific cylinders of said internal combustion engine, said control assembly means being removable from said generator assembly means without altering the timing relationship between the rotatable unit and said engine.

5. An ignition system for providing spark ignition to the cylinders of an internal combustion engine comprising a generator assembly means adapted to be mounted on said engine, said generator assembly means including a generator housing having a first housing section formed to define a magneto receiving chamber having a cross sectional dimension at a first extremity which is greater than the cross sectional dimension at a second extremity opposed to and spaced from said first extremity and a second housing section spaced from said first housing section by a dividing wall, a magneto means mounted in said first housing section and adapted to be driven in response to the operation of said engine to provide output power, said magneto means including a magneto stator having at least one high speed stator coil mounted in said magneto receiving chamber in the area thereof adjacent to said second extremity and at least one low speed stator coil having a number of coil windings which exceeds the number of coil windings of said high speed stator coil, said low speed stator coil being mounted in said magneto receiving chamber in the area thereof adjacent said first extremity, and timing means including at least one rotatable unit driven in timing relationship to the operation of said engine mounted in said second housing section, and a control assembly means removably mounted on said generator assembly means, said control assembly means including ignition control circuit means connected to receive power from said magneto means and operative in response to said timing means to provide spark ignition to specific cylinders of said internal combustion engine, said control assembly means being removable from said generator assembly means without altering the timing relationship between said rotatable unit and said engine.

6. The ignition system of claim 1 wherein said timing means includes a pulse timing generator means and a distributor means for providing triggering pulses to said ignition control circuit means, said distributor means including a distributor stator means included in said control assembly means and a distributor rotor means included in said generator assembly means, said pulse timing generator means operating to provide timing pulses to said distributor rotor means.

7. The ignition system of claim 6 wherein said ignition control circuit means includes a plurality of electronic switching means, each activated upon receipt of a triggering pulse to provide a current path therethrough, said distributor stator means including a plurality of spaced pole means, each of said pole means being connected to provide a trigger pulse to one of said plurality of electronic switching means, said distributor rotor means being operative to rotate past said spaced pole means when said control assembly means is mounted upon said generator assembly means and to induce a triggering pulse in an adjacent pole means upon receipt by said distributor rotor means of a timing pulse from said timing generator means.

8. The ignition system of claim 7 wherein said ignition control circuit means includes capacitor means connected to receive output power from said magneto means, said capacitor means being connected to said plurality of electronic switching means and operating to charge in response to the receipt of output power from said magneto means and to discharge through an activated electronic switching means, each said electronic switching means having a maximum pulse current carrying capability.

9. The ignition system of claim 8 wherein said ignition control circuit means includes inductor means connected in the discharge path between said capacitor means and said plurality of electronic switching means, the LC circuit value of said capacitor means and inductor means being such as to limit the peak value of current flow to each of said electronic switching means to a level below the pulse current carrying capability of said electronic switching means.

10. The ignition system of claim 6 wherein said distributor stator means is formed and positioned to extend concentrically about said distributor rotor means when said control assembly means is mounted upon said generator assembly means.

11. The ignition system of claim 1 wherein said generator assembly means includes a generator assembly housing having a first housing section and a second housing section separated from said first housing section by a dividing wall, said magneto means being mounted in said first housing section and said timing means being mounted in said second housing section.

12. The ignition system of claim 11 which includes drive means extending through said dividing wall and coupling said magneto means to the rotatable member of said timing means.

13. The ignition system of claim 12 wherein said timing means rotatable member is mounted to extend outwardly beyond the confines of said second housing section, and said control assembly means including a stator means formed and positioned to extend concentrically about said timing means rotatable member when said control assembly means is mounted upon said generator assembly means.

14. The ignition system of claim 11 wherein said dividing wall is a thermal isolating wall which operates with said second housing section to thermally isolate said control assembly means from said magneto means when the control assembly means is mounted upon said generator assembly means.

15. The ignition system of claim 5 wherein said magneto stator includes two low speed stator coils mounted in said magneto receiving chamber in the area thereof adjacent to said first extremity, one high speed stator coil mounted in said magneto receiving chamber in the area thereof adjacent to said second extremity and a power coil electrically isolated from said high and low speed coils, said power coil being mounted in said magneto receiving chamber in the area thereof adjacent to said second extremity.

16. The ignition system of claim 1 wherein said ignition control circuit means includes capacitor means connected to receive the output from said high and low speed stator coils and a plurality of electronic switching means, each said switching means being activated upon receipt of a triggering pulse, said capacitor means being connected to said plurality of electronic switching means and operating to charge in response to the receipt of the output from said low and high speed stator coils and to discharge through an activated electronic switching means.

17. The ignition system of claim 2 wherein said programmable timing means is connected to receive power from said second stator coil means.

18. The ignition system of claim 2 which includes inductor means connected in the discharge path between said capacitor means and said plurality of electronic switching means, the LC circuit value of said capacitor means and said inductor means being such as to limit the peak value of current flow to each of said electronic switching means to a level below the pulse current carrying capability of each of said electronic switching means.

19. The ignition system of claim 2 which includes a generator assembly means adapted to be mounted on said engine, said generator assembly means including said magneto means and said triggering means including at least one rotatable unit mounted in said generator assembly means and driven in timing relationship to the operation of said engine, and a control assembly means removably mounted on said generator assembly means, said control assembly including said electronic switching means, capacitor means and variable programmable timing means, said control assembly means being removable from said generator assembly means without altering the timing relationship between said rotatable unit and the engine.

20. The ignition system of claim 19 wherein said triggering means includes a pulse timing generator means and a distributor means for providing triggering pulses to said electronic switching means, said distributor means including a distributor stator means included in said control assembly means and a distributor rotor means forming the rotatable unit in said generator assembly means, said pulse timing generator means operating to provide timing pulses to said distributor rotor means.

21. The ignition system of claim 20 wherein said distributor stator means includes a plurality of spaced pole means, each of said pole means being connected to provide a trigger pulse to one of said plurality of electronic switching means, said distributor rotor means being operative to rotate past said spaced pole means when said control assembly means is mounted upon said generator assembly means and to induce a triggering pulse in an adjacent pole means upon receipt by said distributor rotor means of a timing pulse from said timing generator means.

22. The ignition system of claim 21 wherein each said electronic switching means has a maximum pulse current carrying capability and wherein inductor means are connected in the discharge path between said capacitor means and said plurality of electronic switching means, the LC circuit value of said capacitor means and inductor means being such as to limit the peak value of current flow to each of said electronic switching means to a level below the pulse current carrying capability of said electronic switching means.

23. The ignition system of claim 20 wherein said distributor stator means is formed and positioned to extend concentrically about said distributor rotor means when said control assembly means is mounted upon said generator assembly means.

24. The ignition system of claim 20 wherein said generator assembly means includes a generator assembly housing having a first housing section and a second housing section separated from said first housing section by a dividing wall, said magneto means being mounted in said first housing section and said pulse timing generator means being mounted in said second housing section.

25. The ignition system of claim 24 which includes drive means extending through said dividing wall and coupling said magneto means to said pulse timing generator means and said distributor rotor.

26. The ignition system of claim 25 wherein said distributor rotor is mounted to extend outwardly beyond the confines of said second housing section, and said distributor stator means is formed and positioned to extend concentrically about said distributor rotor when said control assembly means is mounted upon said generator assembly means.

27. The ignition system of claim 24 wherein said dividing wall is a thermal isolating wall which operates with said second housing section to thermally isolate said control assembly means from said magneto means when the control assembly means is mounted upon said generator assembly means.

28. The ignition system of claim 24 wherein said first housing section is formed to define a magneto receiving chamber having a cross sectional dimension at a first extremity which is greater than the cross sectional dimension at a second extremity opposed to and spaced from said first extremity, said first stator coil means including at least one high speed stator coil mounted in said magneto receiving chamber in the area thereof adjacent to said second extremity and at least one low speed stator coil having a number of coil windings which exceeds the number of coil windings of said high speed stator coil, said low speed stator coil being mounted in said magneto receiving chamber in the area thereof adjacent said first extremity.

29. The ignition system of claim 28 wherein said first stator coil means includes two low speed stator coils mounted in said magneto receiving chamber in the area thereof adjacent to said first extremity and one high speed stator coil mounted in said first magneto receiving chamber in the area thereof adjacent to said second extremity, said second stator coil means including at least one power coil electrically isolated from said high and low speed coils, said power coil being mounted in said magneto receiving chamber in the area thereof adjacent to said second extremity.

30. The ignition system of claim 2 which includes ignition coils having primary and secondary windings, each of said electronic switching means including an anode, cathode and gate electrode, an anode to cathode electrode circuit of each such electronic switching means being connected in series with the primary winding of an ignition coil and the gate electrode being connected to said triggering means, said programmable timing means being connected to the cathode electrodes of said electronic switching means and operable to provide a variable bias potential at said cathode electrodes.

31. The ignition system of claim 3 wherein said timing means includes a pulse timing generator means and a distributor means for providing triggering pulses to said ignition control circuit means, said distributor means including a distributor stator means forming the stator means of said control assembly means and a distributor rotor means forming the rotatable unit of said generator assembly means, said pulse timing generator means operating to provide timing pulses to said distributor rotor means.

32. The ignition system of claim 31 wherein said ignition control circuit means includes a plurality of electronic switching means, each activated upon receipt of a triggering pulse to provide a current path therethrough, said distributor stator means including a plurality of spaced pole means, each of said pole means being connected to provide a trigger pulse to one of said plurality of electronic switching means, said distributor rotor means being operative to rotate past said spaced pole means when said control assembly means is mounted upon said generator assembly means and to induce a triggering pulse in an adjacent pole means upon receipt by said distributor rotor means of a timing pulse from said timing generator means.

33. The ignition system of claim 32 wherein said ignition control circuit means includes capacitor means connected to receive output power from said magneto means, said capacitor means being connected to said plurality of electronic switching means and operating to charge in response to the receipt of output power from said magneto means and to discharge through an activated electronic switching means, each said electronic switching means having a maximum pulse current carrying capability.

34. The ignition system of claim 33 wherein said ignition control circuit means includes inductor means connected in the discharge path between said capacitor means and said plurality of electronic switching means, the LC circuit value of said capacitor means and inductor means being such as to limit the peak value of current flow to each of said electronic switching means to a level below the pulse current carrying capability of said electronic switching means.

* * * * *